US005328017A

United States Patent [19]

Carlen

[11] Patent Number: 5,328,017

[45] Date of Patent: Jul. 12, 1994

[54] GRIPPER CONVEYOR II

[75] Inventor: Bo Carlen, Sollentuna, Sweden

[73] Assignee: Idab-Wamac AB, Eksjo, Sweden

[21] Appl. No.: 31,981

[22] Filed: Mar. 16, 1993

[30] Foreign Application Priority Data

Mar. 16, 1992 [SE] Sweden ..... 9200798-8

[51] Int. Cl.[5] ..... B65G 47/46

[52] U.S. Cl. ..... 198/365; 198/803.7; 271/204

[58] Field of Search ..... 198/418.6, 803.7, 470.1, 198/370, 365; 271/82, 85, 204-206, 277; 294/99.1, 104

[56] References Cited

U.S. PATENT DOCUMENTS

| | | | |
|---|---|---|---|
| 4,307,801 | 12/1981 | Hansch | 271/204 |
| 4,381,056 | 4/1983 | Eberle | 198/803.7 |
| 4,921,294 | 5/1990 | Klopfenstein | 294/104 |
| 5,178,262 | 1/1993 | Merkli et al. | 271/204 |

FOREIGN PATENT DOCUMENTS 0356521 5/1988 European Pat. Off. .

*Primary Examiner*—Joseph E. Valenza
*Attorney, Agent, or Firm*—Keck, Mahin & Cate

[57] ABSTRACT

A gripper conveyor comprises a moving conveyor chain (1) which is provided with grippers (3), each of which includes a fixed clamping jaw (31), a pivotal clamping jaw (33) and a spring element (36) which biases respective grippers towards their closed positions and an opening mechanism (6; 41, 42, 68) which functions to open selected grippers (3) while the conveyor chain (1) is moving. The pivotal clamping jaw (33) of the gripper (3) is connected to a manoeuvering arm (37) which is activated by the opening mechanism. The manoeuvering arm (37) is mounted for limited pivotal movement in relation to the movable clamping jaw (33). An end-position element (45; 371) is provided for defining a pivotal end-position of the manoeuvering arm in a direction away from the movable clamping jaw. A biasing element (35) which is weaker than the spring element (36) functions to bias the manoeuvering arm (37) in a direction towards its end position.

8 Claims, 3 Drawing Sheets

Fig. 7
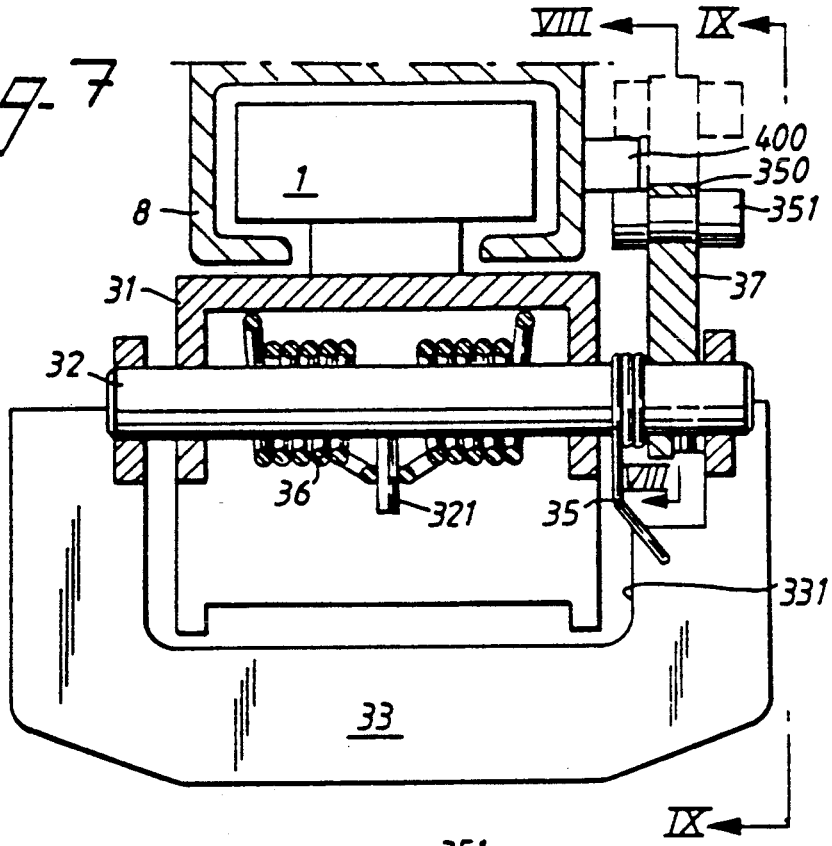
Fig. 8
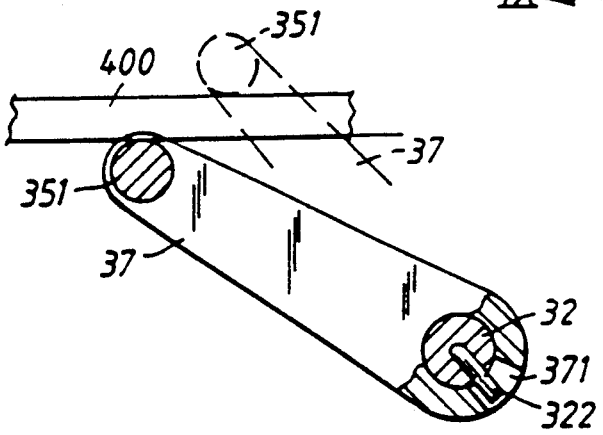
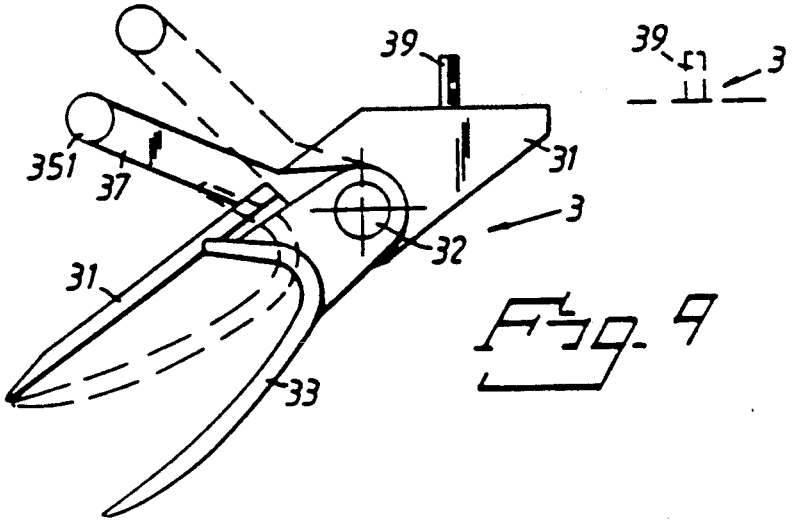
Fig. 9

GRIPPER CONVEYOR II

The present invention relates to a gripper conveyor of the kind which includes a circumferentially extending conveyor chain which is provided with grippers each of which includes a fixed clamping jaw, a pivotally movable clamping jaw and a spring means which permanently biases the gripper towards a closed position, and which further includes gripper opening means which function to open a selected gripper as the conveyor chain moves, wherein the movable clamping jaw of the gripper has a manoeuvering arm which is acted upon by the gripper opening means.

Gripper conveyors of the aforesaid kind are known to the art and are often used to pick-up, in a given position, newspapers or like flat articles which are conveyed in mutually overlapping relationship on a conveyor path and for releasing transported newspapers and like flat articles at another position along the chain. It should be mentioned here that the term "newspaper" as used in this document is meant to include any type of printed matter and also flat articles that may be conveyed in overlapping relationship.

The grippers are opened and the gripper conveyor is controlled in a manner such that the free edge of the movable clamping jaws will engage a in the overlapping stream, wherewith the next following newspaper in the stream will move into the open gripper due to a difference in speed between the newspaper stream and the gripper conveyor.

In order to limit the complexity of the gripper conveyor and to ensure that the grippers will function effectively, particularly with regard to manufacturing costs, it has been suggested to use grippers of the aforedescribed, i.e. grippers which are permanently spring-biased towards a closed position.

The grippers are opened by activating the movable clamping jaw with the aid of the manoeuvering arm, by causing the manoeuvering arm to run on a guide bar or rail such as to swing the manoeuvering arm, wherein the length of the bar determines the time period over which the gripper is held open.

In the known gripper conveyor, as far as it has hitherto been described, the distance from the end of the manoeuvering arm from the movement path of the fixed gripper jaws will vary in accordance with the thickness of the newspaper or like article to be gripped. This can create a problem in connection with the release of the newspaper when the gripper is opened.

EP-0 356 521 teaches a gripper which includes two clamping jaws which can be moved linearly towards one another into clamping coaction by means of a spring. One clamping jaw is provided between its end with a pivot journal having a latching means, so as to enable the outer part of the clamping arm to be released through the action of the latching means and therewith swing outwardly around the pivot journal and cause the gripper to release the gripped article. The clamping arms are therefore not permanently biased into gripping coaction and a releasable latching mechanism and a pivot journal are required between the ends of one clamping arm. When the known gripper is to be caused to grip an article, the arms must first be parted linearly under tension, and the outer arm part must then swing outwardly of the pivot journal past the position of the latching mechanism. It is not until then that the clamping arms can be caused to move towards one another under the influence of the gripping spring, to grip the article. This latching mechanism which locks the pivot journal of the outer arm part is also intended to be influenced by other actuating means than those which activate opening of the grippers (i.e. tension the gripper closing spring).

Consequently, an object of the present invention is to provide a gripper which does not require a separate latching mechanism or the provision of a pivot journal between the ends of the movable clamping arm and with which the clamping jaws are permanently biased towards one another by said spring means, wherein the clamping arms are preferably mutually pivotal, wherein the object also includes the provision of a solution to the earlier mentioned problem. These objects are achieved in accordance with the invention with the gripper conveyor defined in the following claim 1. Other embodiments of the invention are defined in the dependent claims.

According to one embodiment of the invention the manoeuvering arm is mounted in a manner to provide a clearance with the pivotal clamping jaw in the pivoting direction, wherein a relatively weak spring is provided for biasing the manoeuvering arm towards an outwardly swung, outer end-position which is essentially always the same irrespective of the thickness of a newspaper gripped by the gripper. With regard to such gripper conveyors, a further problem resides in the fact that the free edge of the movable clamping jaw will be swung down to a given level which is determined by the level of said bar when the gripper is opened, although the free edge of the movable clamping jaw will preferably lie with a small abutment force against a support surface in the open position of the gripper at any selected level in order to correctly grip, for instance, a newspaper in an overlapping stream of newspapers on the conveyor path, irrespective of a variation in the level of the newspaper surfaces, for instance due to variations in newspaper thickness, variations in the extent to which the newspapers overlap and so on. This problem is accentuated by interruptions and at the end of a stream of overlapping newspapers.

This additional problem can be solved in principle by mounting the movable clamping jaw so as to provide a clearance in the direction of pivotal movement and so that the movable clamping jaw is able to move freely through a limited pivot angle relative to the manoeuvering arm subsequent to gripper activation, so that the movable clamping jaw is able to lie against the surface of the newspaper stream with a given clearance range between the free edge of the fixed clamping jaw and the surface on which the free edge of the movable clamping jaw shall rest in order to grip a newspaper. According to one embodiment of the invention, a relatively weak spring may be provided for activating the movable clamping jaw in the opening direction so as to enable the movable jaw to be rapidly swung out to an opening position subsequent to opening activation by the manoeuvering arm. Thus, as a result of the relatively weak spring, it is not necessary to rely on the effect of gravity to open the clamping jaw and to promote pivotal movement of the movable jaw.

The relatively weak spring may be constructed so that its opening force will decrease proportionally to the outward swinging movement of the movable clamping jaw such that this swinging movement is initially very quick while the force with which the clamping jaw lies against the stream of newspapers will nevertheless be relatively small. Thus, when the stream of newspapers passes generally horizontally beneath the forwardly moving row of grippers, it can suffice to allow gravity to ensure that the movable clamping jaw will be swung out, by placing the center of gravity of the movable clamping jaw at a distance from the pivot point of the movable clamping jaw. However, this outward swinging movement can be made more certain with the aid of the aforesaid relatively weak spring, which also permits the movable clamping jaw to swing outwards in other gripper orientations.

In this regard, one and the same relative weak spring can be used to activate the movable clamping jaw towards its outwardly swung position in the opened state of the gripper, and also to bias the manoeuvering arm towards its outwardly swung position in the gripping state of said gripper.

The gripper manoeuvering arm may extend into contact with a stationary bar, so that the manoeuvering arm will be moved away as the movable clamping jaw is swung away from the fixed clamping jaw.

If only one single gripper is to be opened with the aid of one such rail, a problem arises relating to the fact that a conveyor of the aforesaid kind may have a gripper spacing or pitch of about 50 mm and a conveying capacity of, for instance, 60,000 copies per hour. It will be understood that the bar may be inserted into the movement path of the gripper manoeuvering arms and therewith be in contact with said arm only for a very short period of time (before the next gripper manoeuvering arm arrives and is activated by the bar). During this short period of time at disposal for activating an individual gripper manoeuvering arm, there is no time for the newspaper to fall out of the gripper. It has therefore been suggested that the jaw opening means shall include activating devices which are each capable of activating a manoeuvering arm so as to open the gripper concerned, wherein the activating devices are caused to accompany the gripper in its movement over a distance of such length (a period of such duration) that the newspaper will actually have time to fall from the gripper. The inventive gripper construction in which the end of the manoeuvering arm is sprung back to a position which lies at a considerable distance transversely to the gripper chain from the position it occupied when the gripper grasped a newspaper, irrespective of the thickness of the newspaper, enables another alternative opening means to be used. This alternative opening means includes a long bar which holds an opened gripper open along a conveying distance which is greater than the distance between mutually adjacent grippers. A shoulder on the end of the gripper manoeuvering arm can always pass on one side of the single, long bar, since the end of the manoeuvering arm is always returned to said outer position, so as to exclude the risk of the shoulder colliding with the upstream end of the bar when the newspaper concerned has considerable thickness. The alternative opening means also includes means which function to move the end of the manoeuvering arm of an individual gripper to the open gripper position, so as to enable the shoulder on the end of the manoeuvering arm to move forwards into contact with the other side of the long bar and to slide along this other side, such as to hold the gripper open along the full length of this long bar. The shoulder on the end of the manoeuvering arm passes free at the downstream end of the bar, so as to close the gripper automatically. The aforesaid means may, for instance, include a plunger which is movable transversely to the direction of movement of the grippers, or a flap which is pivotally mounted on the upstream end of the bar and pivotal into and away from the path of the shoulders on the ends of respective manoeuvering arms, so as to enable these shoulders either to pass freely on one side of the bar or to cause the shoulders to slide up into abutment with the other side of the bar and therewith open the gripper and hold the gripper open along the length of the long bar. The aforesaid means, for instance, in the form of a plunger or a flap, should, of course, have a small length in the direction of movement of the conveyor, for instance, a height which is smaller than the division between the grippers, so as to enable one gripper to be opened without disturbing the following grippers.

As will be understood, the opening means may be constructed to enable a few newspapers, for instance, one particular section of the newspapers or each alternate newspaper or each third newspaper in the newspaper stream or the like to be gripped, and may, of course, also be constructed to open all grippers.

The means for opening an individual gripper prior to guiding the gripper into geared coaction with the long bar may include a circumferentially extending conveyor belt having mounted thereon controllable dogging elements which can be moved selectively to an active position in which they coact with a selected gripper, said actuator conveyor belt moving in generally the same direction and at generally the same speed as the conveyor chain of the gripper conveyor in the gripper opening region. The actuators may, for instance, include pins which are axially displaceable in hollow shafts which connect the links of the actuator conveyor chain, wherein a plunger moves a selected pin to its operative position, while the extended pins are returned to their inoperative position by a wedge-shaped ramp subsequent to their coaction with a gripper. The invention will now be described in more detail with reference to exemplifying embodiments thereof and also with reference to the accompanying drawings, in which FIGS. 1A and 1B illustrate schematically a first embodiment of a gripper forming part of the inventive conveyor;

FIG. 7 is a sectional view of a gripper embodiment at present preferred; and FIGS. 8 and 9 are views taken on the line VIII and XI respectively in FIG. 7.

An inventive gripper conveyor may typically include an endless, driven conveyor chain which is guided for movement in a channel profile and which carries grippers mounted at uniform distances apart along the chain. Mounted at selected positions along the chain path are gripper opening devices which enable the grippers to open so as to grip and to release articles, such as newspapers or like publications.

Figure 1A:
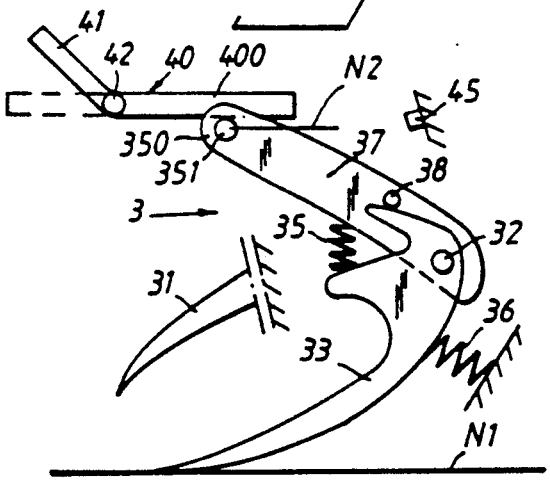
Figure 1B:
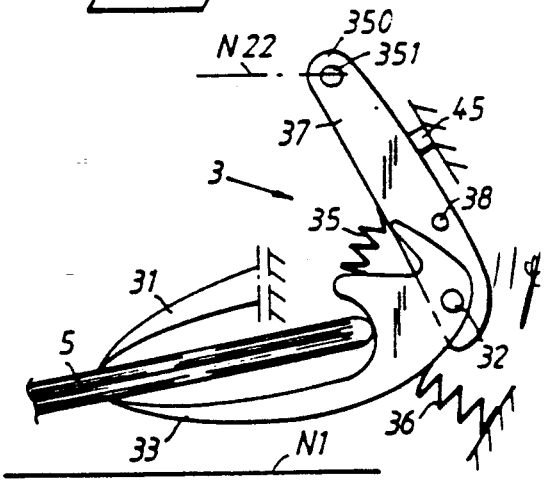

Referring to FIG. 1A, it is assumed that a stream of mutually overlapping newspapers (as hereinbefore defined) rest on a level N1 corresponding to the level of a conveyor belt which moves to the right in FIG. 1A at a speed which is slightly greater than the speed at which the gripper 3, shown in FIG. 1A, moves to the right in said Figure.

As will be seen from FIG. 1A, the gripper 3 comprises a fixed gripper jaw 31 which carries a movable clamping jaw 33 on a shaft 32. The fixed jaw 31 is assumed to be permanently connected to a link of the conveyor chain. A gripper manoeuvering arm 37 is pivotally mounted on the shaft 32 and has an end-part/-lower part 38 which functions to dog the movable clamping jaw 33 in the closing direction of the gripper. The free end 350 of the manoeuvering arm 37 is provided with a pin 351 which is able to coact with a guide cam 40. A strong closing spring acts on the movable jaw 33.

A relatively weak spring 35 biases the manoeuvering arm 37 clockwise towards an abutment 45, such that the pin 351 on the arm 37 is returned to a generally defined end-position N22 when the gripper is closed, irrespective of the thickness of the gripped article.

In the illustrated embodiment, the arm 37 is journalled on the shaft 32, although it will be understood that other positions of the arm abutment and the restoring journal lie within the scope of the invention.

The closing spring 36 acts indirectly but permanently against the movable clamping jaw in a jaw closing direction, wherein the manoeuvering arm is able to restrain the spring 36. In the embodiment illustrated in FIGS. 2*a*, 2*b* the spring 36 acts on the manoeuvering arm which acts, via the lever 130, on the movable clamping jaw such that when open this movable jaw is essentially freely movable from an end position in which it contacts the dogging means in a direction towards a closing position and back to said end position.

Figure 2A:
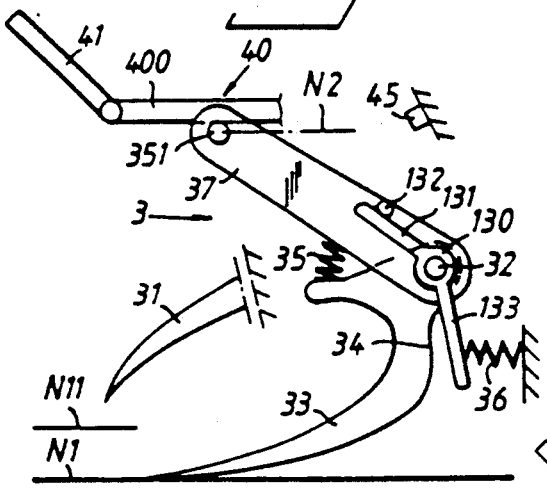
FIGS. 2A and 2B illustrate schematically a second embodiment of the gripper.
Figure 2B:
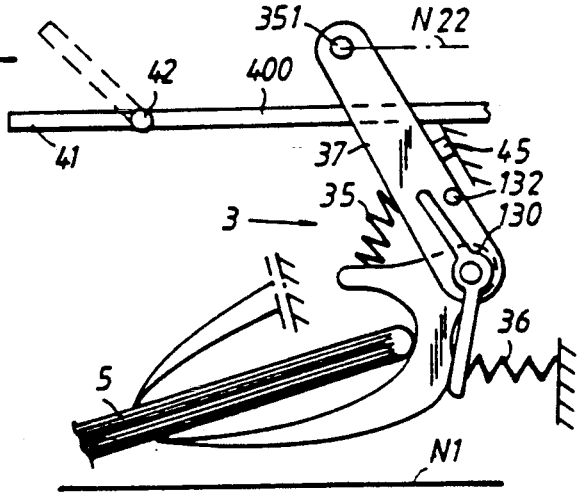

Thus, in the case of the embodiment illustrated in FIGS. 2*a*, 2*b*, when the jaw 33 is open it can swing against the action of solely the weak restoring spring 35, or solely the action of gravity, (which biases the movable jaw 33 towards a maximum open position) in a direction towards the closing position, despite the fact that the manoeuvering arm is activated to open the gripper against the action of the powerful closing spring 36.

In the case of the embodiment illustrated in FIG. 2A, the free edge of the jaw 33 can take any level above N1. It will be understood that the gripper according to the FIG. 2 embodiment enables the movable gripping jaw 33 to take a correct position for gripping a newspaper in the newspaper stream also at the beginning of the stream, or in the vicinity of a discontinuity in the stream and irrespective of the thickness of the newspapers in said stream.

Referring now to FIG. 2A, it will be seen that the shaft 32 carries a pivotally journalled double-arm lever 130, one arm 131 of which coacts with an abutment 132 on the manoeuvering arm 37 and the other arm 133 of which coacts with an outer counterpressure surface 34 on the pivotal clamping jaw 33. The spring 35 acts between the movable clamping jaw 33 and the manoeuvering arm 37. The gripper 3 is opened by coaction with the cam 40, in that the abutment 132 causes the lever 130 to be swung anticlockwise and enable the jaw 33 to swing downwards under the influence of the force of gravity and/or the force exerted by the spring 35. The closing spring 36 acts indirectly but permanently on the movable jaw to close the same, wherein the manoeuvering arm is able to carry the load of the spring 36.

Turning now to FIG. 2B, it will be seen that when the gripper 3 is closed by means of the spring 36, the spring 35 has swung the manoeuvering arm 35 to one side in a clockwise direction, so that the abutment 132 is distanced from the lever leg 131 through a given angle, such as to establish a predetermined distance between the levels N22 and N2 for the pin 351 transversely to the gripper conveyor chain, even when the thickness of the gripped article 5 reaches a maximum value, so that the pin 351, if so desired, is able to pass on the upper side of a bar 400 corresponding to the horizontal leg of the cam 40 in the FIG. 2A or the FIG. 1A illustration.

In this way, the sloping leg 41 of the cam 40 can be hinged by a pivot 42 and be displaceable to a horizontal position, shown in FIG. 2B, to enable the gripper 3 to pass without being opened. Restoring movement of the manoeuvering arm 37 is limited to a given position, which can be defined with the aid of a fixed stop 45, or by the non-loaded state of the spring.

Figure 3:
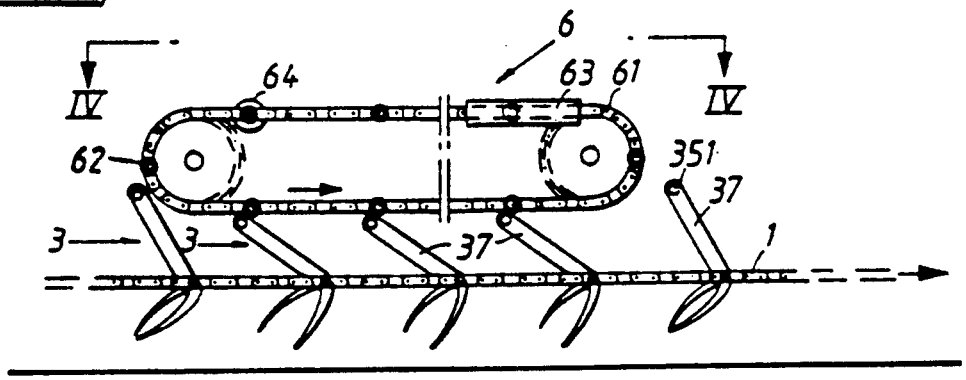
FIGS. 3 and 4 illustrate schematically an inventive conveyor, in side view and in horizontal view respectively.
Figure 4:
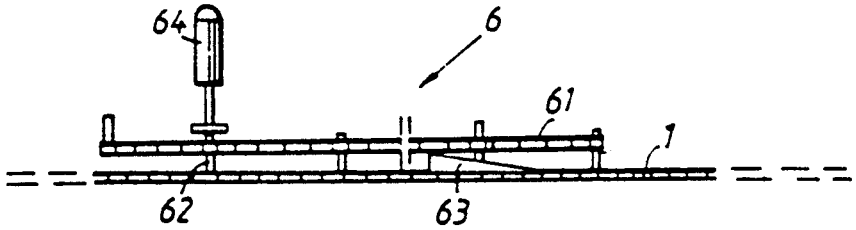

Referring now to FIG. 3, it will be seen that an opening means for the grippers on the conveyor chain 1 may include an endless chain 61 of which the upper part, or run, moves parallel with the chain 1 along a chosen distance which is greater than the spacing of the grippers on the chain 1. Referring to FIG. 4, it will be seen that the links of the chain 61 are coupled through the agency of hollow shafts in which pins 62 are axially movable. Mounted along the upper run of the chain 61 is a wedge ramp 63 which functions to return the pins 62 to one end position. Also provided is a plunger arrangement 64 which functions to selectively move pins 62 to their other end position. The link shafts of the chain 61 have a division or pitch corresponding to the division or pitch of the grippers 3 on the chain 1, and the chain 61 moves synchronously with the chain 1, so that pins 62 driven out by the plunger 64 will come into engagement with the end 35 of the manoeuvering arm (the pin 351) on the grippers 3 and open the gripper, wherein the outwardly moved pins 62 move together with the gripper and hold the gripper open along the lower part or bottom run of the chain 61, without causing an obstruction to the forward upstream or downstream grippers 3.

Figure 5:
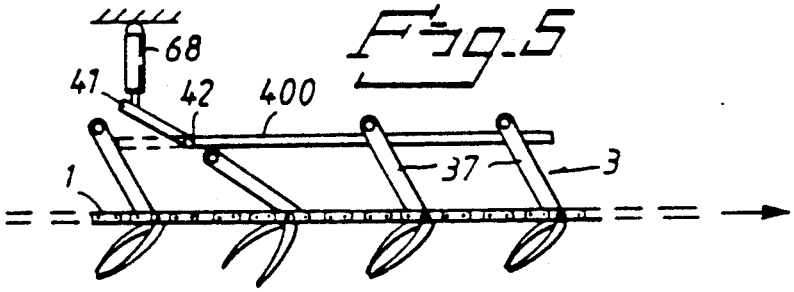
FIG. 5 illustrates the coaction between a gripper according to FIG. 2 and an opening means which can be used with the gripper according to FIG. 2 irrespective of the gripper width.

FIG. 5 illustrates schematically the opening means indicated in FIGS. 2A, 2B. As will be seen, the opening means includes a stationary bar 400 which extends parallel with the chain 1 along a distance which is greater than the distance between mutually adjacent grippers, i.e. the gripper spacing. A flap 41 is pivotally mounted on a pivot journal 42 at the upstream end of the bar 40. The flap 41 is pivoted by means of a piston-cylinder device 68 between a position in which the flap 42 forms a camming surface which functions to open an arriving gripper, and a position in which the flap 41 lies in line with the bar 400 and thus enables the pins 351 to pass on the upper side of the flap 42 and the bar 400.

The length of the flap 41 is shorter than the spacing between the grippers on the chain 1.

Figure 6:
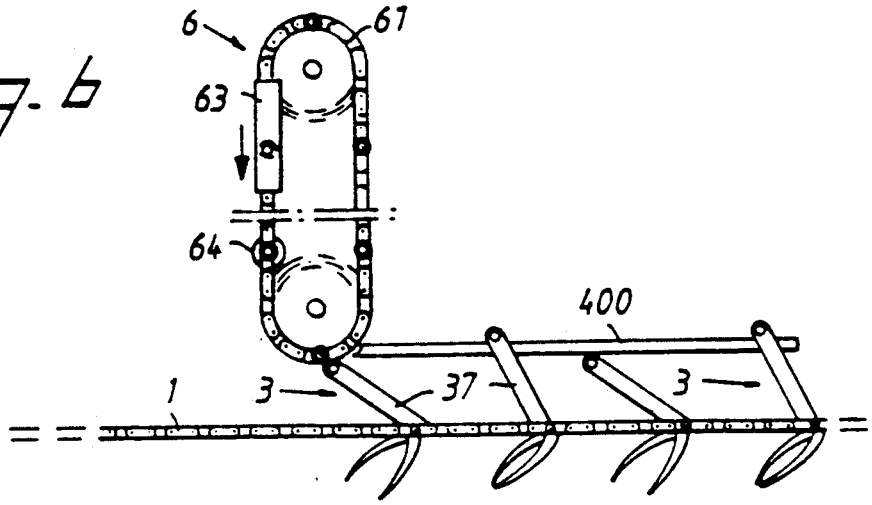
FIG. 6 illustrates schematically another opening means for an inventive gripper conveyor.

FIG. 6 illustrates an embodiment of an opening means which although based on the construction illustrated in FIG. 5 has a circumferentially extending opening means 6 which is fully analogous with the construction illustrated in FIG. 5, instead of the pivotal flap 41 and its piston-cylinder drive device 68.

With reference to FIGS. 5 and 6, it will be seen that it is important that the end 35 of the gripper manoeuvering arm is swung up to a level which is in line with the upper side of the bar 400, subsequent to gripping a newspaper 5 and irrespective of the thickness of the gripped newspaper 5.

The embodiment illustrated in FIGS. 7–9 includes a chain guide rail 8 which guides the links of the chain 1, which in turn are fixedly mounted on the fixed clamping jaw 31 carrying the rotatable shaft 32 and the movable clamping jaw 33 fixedly connected to said shaft. The shaft 32 is provided with a radial pin 321 which forms an attachment point for the double coil spring 36 whose ends bear against the fixed clamping jaw 31.

The manoeuvering arm 37 is journalled for rotation on the shaft 32 and has a sector-shaped recess 371 (FIG. 8) which receives a radial pin 322 on the shaft 32.

The sector angle of the recess 371 of the arm 37 is such that the arm illustrated in FIG. 8 is able to swing clockwise after the gripper jaws 31, 33 have been brought together with a newspaper gripped therebetween or in the absence of a newspaper, whereby the pin 351 can be moved transversely to the direction of the chain 1 through at least a distance which corresponds to the thickness of the bar 400, even though the gripping width between the jaws 31, 33 has been fully utilized.

FIG. 9 illustrates the gripper in a fully opened position and in a fully closed position. It will be seen that the short division, indicated in FIG. 9 by the pins 39 connecting the grippers to the chain 31, implies a risk that the movable jaw 33 on a following gripper will strike against the free edge of the fixed jaw 31 of a preceding gripper, and consequently the movable clamping jaws 33 are provided with a central recess 331 which is able to accommodate the free edge of the fixed jaw 31 of the preceding gripper.

I claim:

1. A gripper conveyor comprising a moving conveyor chain (1) which is provided with grippers (3) each of which includes a fixed clamping jaw (31), a pivotal clamping jaw (33) and a spring means (36) which permanently biases the gripper towards a closed position, and an opening mechanism (6; 41, 42, 68) which functions to open selected grippers (3) while the conveyor chain (1) is moving, wherein the pivotal jaw (33) of the gripper (3) is connected to a manoeuvering arm (37) which is actuable by the opening mechanism, characterized in that the manoeuvering arm (37) is mounted for limited pivotal movement in relation to the movable clamping jaw (33); in that an end-position means (45; 371) is arranged to define a pivot end-position of the manoeuvering arm in a direction away from the movable clamping jaw; and in that the conveyor also includes a biasing means (35) which is weaker than the spring means (36) and which functions to bias the manoeuvering arm (37) in a direction towards its end position.

2. A gripper conveyor according to claim 1, characterized in that the movable clamping jaw (33) is mounted for limited pivotal movement in relation to the manoeuvering arm (37) in the open state of the gripper; and in that means (331; 35) are provided for driving the movable clamping jaw (33) towards its outer end-position in the pivoting direction in the opening-activating state of the manoeuvering arm (37).

3. A gripper conveyor according to claim 2, characterized in that the movable jaw drive means (331) includes the feature of locating the center of gravity (331) of the movable clamping jaw (33) at a horizontal distance from the pivot axis (32) of the movable jaw (33); and in that the grippers are intended to move above a stream of articles that are to be gripped by the grippers.

4. A gripper conveyor according to claim 2, characterized in that said means includes a spring (35) which is much weaker than the spring means (36) and which is intended to pivotally bias the movable clamping jaw (33) in its opening direction.

5. A gripper conveyor according to claim 1, characterized in that the manoeuvering arm (37) is mounted with a limited freedom of movement in the pivotal direction relative to a shaft (32) which carries the movable clamping jaw (33); and in that a spring (35) which is much weaker than the spring means (36) is intended to bear against the manoeuvering arm (37) in a manner to swing said arm outwards away from the pivotal clamping jaw (33) in the gripping position of said jaw.

6. A gripper conveyor according to claim 5, characterized in that the relatively weak spring (35) which functions to swing the manoeuvering arm (37) to its outwardly swung position is the same spring (35) as that which biases the pivotal clamping jaw (33) towards its outwardly swung position.

7. A gripper conveyor according to claim 5, characterized in that the angle through which the manoeuvering arm (37) swings in relation to the movable clamping jaw (33) is at least equally as large as the maximum permitted opening angle between the clamping jaws (31, 33) of the gripper.

8. A gripper conveyor according to claim 5, characterized in that the opening mechanism includes means (68, 41, 42; 6') for opening an individual gripper independently of adjacent grippers, and a guide bar whose length exceeds the division or spacing between the grippers (3) on the chain (1) and extends parallel with said chain, and in that the bar (400) supports the end of the manoeuvering arm of the opened gripper while sliding along the bar (400).

* * * * *